US009987681B2

(12) United States Patent
Prabhu et al.

(10) Patent No.: US 9,987,681 B2
(45) Date of Patent: Jun. 5, 2018

(54) METHOD OF REPLACING A NOZZLE ASSEMBLY FOR A MOLTEN METAL HOLDING AND POURING BOX WITH DUAL POURING NOZZLES

(71) Applicant: INDUCTOTHERM CORP., Rancocas, NJ (US)

(72) Inventors: Satyen N. Prabhu, Voorhees, NJ (US); William R. Pflug, Mount Laurel, NJ (US); Marcelo Albano Paiva, Delran, NJ (US); Graham Cooper, Queensland (AU)

(73) Assignee: INDUCTOTHERM CORP., Rancocas, NJ (US)

( * ) Notice: Subject to any disclaimer, the term of this patent is extended or adjusted under 35 U.S.C. 154(b) by 0 days. days.

(21) Appl. No.: 15/193,085

(22) Filed: Jun. 26, 2016

(65) Prior Publication Data

US 2016/0303648 A1 Oct. 20, 2016

Related U.S. Application Data

(62) Division of application No. 13/533,414, filed on Jun. 26, 2012, now Pat. No. 9,375,785.

(60) Provisional application No. 61/501,235, filed on Jun. 26, 2011.

(51) Int. Cl.

| | |
|---|---|
| ***B22D 41/08*** | (2006.01) |
| ***B22D 37/00*** | (2006.01) |
| ***B22D 41/16*** | (2006.01) |
| ***B22D 41/18*** | (2006.01) |
| ***B22D 41/50*** | (2006.01) |
| ***B22D 23/00*** | (2006.01) |
| ***B22D 41/54*** | (2006.01) |

(52) U.S. Cl.
CPC ..... *B22D 41/08* (2013.01); *B22D 23/00* (2013.01); *B22D 37/00* (2013.01); *B22D 41/16* (2013.01); *B22D 41/18* (2013.01); *B22D 41/50* (2013.01); *B22D 41/54* (2013.01); *Y10T 29/4973* (2015.01)

(58) Field of Classification Search
CPC ..... B22D 41/50; B22D 41/52; B22D 41/56
See application file for complete search history.

(56) References Cited

U.S. PATENT DOCUMENTS

2010/0282784 A1* 11/2010 Paiva ..... B22D 41/20 222/602
2011/0204103 A1 8/2011 Tofuke et al.

FOREIGN PATENT DOCUMENTS

| | | | |
|---|---|---|---|
| JP | H1058100 | A | 3/1998 |
| JP | H11-245017 | A | 9/1999 |
| JP | 2003164961 | A | 6/2003 |
| JP | 2005028429 | A | 2/2005 |
| WO | 00/13822 | A1 | 3/2000 |

* cited by examiner

*Primary Examiner* — Scott Kastler
(74) *Attorney, Agent, or Firm* — Philip O. Post

(57) ABSTRACT

A molten metal holding and pouring box with a rectangular-shaped upper section and a pyramidal-shaped lower section provides a relatively constant flow of molten metal being poured from the box through each of two bottom nozzles into two separate foundry molds at the same time. The two bottom nozzles are contained in a unitary dual nozzle assembly that facilitates replacement as required by wear, or a change in location of the sprue cups in the two separate foundry molds being filled with molten metal.

5 Claims, 9 Drawing Sheets

METHOD OF REPLACING A NOZZLE ASSEMBLY FOR A MOLTEN METAL HOLDING AND POURING BOX WITH DUAL POURING NOZZLES

CROSS REFERENCE TO RELATED APPLICATIONS

This is a divisional application of application Ser. No. 13/533,414, filed Jun. 26, 2012, now U.S. Pat. No. 9,375,785, which application claims the benefit of U.S. Provisional Application No. 61/501,235, filed Jun. 26, 2011, both of which applications are hereby incorporated herein by reference in their entireties.

FIELD OF THE INVENTION

The present invention is related to a pouring and holding box for molten metal having a pyramidal-shaped lower section. The lower section has a bottom region housing a dual nozzle assembly that can be used to independently control the outward flow of molten metal into two casting molds from the box in conjunction with a pair of stopper rods independently controlling the flow of molten metal through two nozzles in the dual nozzle assembly.

BACKGROUND OF THE INVENTION

In foundry installations, molten metal may be handled by various devices, some of which are disclosed in U.S. Pat. No. 2,264,740 (Brown); U.S. Pat. No. 2,333,113 (Martin et al.); U.S. Pat. No. 3,395,840 (Gardner); U.S. Pat. No. 3,549,061 (Piene); U.S. Pat. No. 3,801,083 (Mantey et al.); U.S. Pat. No. 3,848,072 (Dershem et al.); U.S. Pat. No. 4,638,980 (Beele); and U.S. Pat. No. 4,953,761 (Fishman et al.); U.S. Patent Application Publication No. 2010/0282784 A1 (Pavia et al.); and U.K. Patent Application Publication No. GB 2,229,384 A (Fishman et al.).

In such foundry installations, molten metal is frequently poured from a rectangularly-shaped, or otherwise flat bottom holding box into a casting mold. The holding box has a bottom region commonly housing a single nozzle that controls the outward flow of the molten metal. The holding boxes for pouring molten metal are sometimes referred to as ladles, and comprise a substantially enclosed container having a single bottom pour spout commonly controlled by a stopper rod extending vertically through the molten metal in the box. U.S. Patent Application Publication No. 2010/0282784 A1 discloses the use of dual nozzles in a launder. Controlling the flow of the molten metal from the ladle or box to the casting molding is extremely important for successful molding of metal parts. In addition, maintaining the temperature of the nozzle so that it corresponds to approximately that of the molten metal is an important aspect of an efficient pouring process. Further maintaining the liquid, molten state of the metal is also an important consideration, especially when the pouring process encounters unexpected interruptions that may last for a relatively long duration.

As a general rule the flow rate of molten metal being poured from a rectangular box is directly proportional to the square root of the height of the molten metal in the box. This height is commonly referred to as being the "head" parameter. The head parameter (H) directly controls the flow rate (Q) related to the box and both are interrelated by the following relationship:

$$Q \propto \sqrt{H} \qquad \text{[expression (1)]}$$

where Q is equal to the flow rate of the molten metal being poured from the box, and H is equal to the head of molten metal within the box.

The amount of the molten metal that is poured at the flow rate (Q) of expression (1) is also dependent on the volume of the molten metal within the box itself. This volume (equal to the product of L×W×H) is determined by the length (L) and width (W) dimensions of the box, which remain constant. Further, this volume is also dependent upon the height or head parameter (H) of the molten metal in the box. Since the length and width dimensions of the box remain constant, as the head parameter (H) decreases so does the volume (V) of the molten metal within the box, as well as the flow rate (Q). In fact, this relationship dictates that a 75 percent drop in the volume of molten metal contained with a rectangularly-shaped box corresponds to a 75 percent drop in the head parameter (H) and about a 50 percent drop in the flow rate (Q). It is desired that means be provided to yield a flow rate (Q) that is not so directly dependent upon the head parameter (H) when dual nozzles are utilized in a molten metal holding and pouring box having a pyramidal-shaped lower section.

It is desired that a pouring box be provided with means that provide a relatively constant flow of molten metal exiting from the box through a pair of nozzles and being received by a pair of adjacent casting molds. Such a provision allows for the use of dual nozzles having small openings so as to reduce slag formation that would otherwise contribute to the clogging of the nozzles. This constant flow also contributes to the successful molding of metal parts.

Conventional pouring boxes can suffer nozzle clogging problems due to a drop in nozzle temperature during non-pouring delay periods. These delay periods normally occur as the pouring of the molten metal, between the box and the casting molds, is interrupted so as to accommodate sequential mold casting. As the nozzle begins to cool during these sequential delay periods, liquefied slag contained in certain molten metals, as well as the metals themselves, tends to freeze to the inner surface of the pouring nozzle, ultimately leading to clogging of the nozzle.

A further clogging problem can occur because a conventional pouring nozzle may be made of a refractory material and have a construction that comes into contact with both the outer steel shell and a reinforcing plate located around the nozzle of the pouring box. This contact causes the outer shell and the reinforcing plate, both commonly being metal, to act as heat sinks which draw away heat from the pouring nozzle, and thereby decrease the temperature of the nozzle. These heat sink problems may be compensated for by providing a continuous flow of molten metal into the nozzle which counterbalances the removal of heat by the sinks. However, if the pouring of molten metal is not continuous, such nozzle construction leads to the creation of different temperatures along the nozzle which disadvantageously subjects the nozzle to a cooling effect that contributes to clogging.

It is desired that a pouring box with a pyramidal-shaped lower section be provided which has dual nozzles maintained in a heat exchange relationship with the molten metal so as to provide for a constant temperature of the nozzle. Such a construction allows the pouring nozzles to remain at a temperature close to the molten metal in the box, and effectively negates any cooling effect encountered from external devices that would otherwise contribute to clogging problems.

Two (or dual) bottom nozzle pouring boxes can be utilized in mold casting lines where two molds, in-line (in tandem) or side-by-side, are filled with molten metals at the same time. Two individual nozzles 20, as shown, for example, in FIG. 7 may be provided through separate fixed nozzle openings in the bottom of the pyramidal-shaped low section of the box. However this is not preferred since the nozzles will be a fixed distance apart while the distance between sprue cups in a casting line may change. Further replacement of two individual nozzles is time consuming and difficult particular since the change in nozzles is accomplished while the box is extremely hot. Although hot molten metal is drained from the box before nozzle replacement, it is not generally feasible to wait for the box to cool down to around normal room temperature.

It is one object of the present invention to provide a replaceable single (unitary) dual (twin) nozzle (block) assembly in a molten metal holding and pouring box having a pyramidal-shaped lower section that is capable of accommodating casting lines where the distance between the sprue cups of the two molds that are being filled with molten metal flowing through the two nozzles can change.

It is another object of the present invention to provide a replaceable unitary dual nozzle assembly in a molten metal holding and pouring box having a pyramidal-shaped lower section that is more easily replaced than two separate nozzles.

It is another object of the present invention to provide a molten metal holding and pouring box having a pyramidal-shaped lower section with dual pouring nozzles formed from an interchangeable unitary dual nozzle assembly where the spacing between the pair of nozzles in the assembly can be changed based on the selection of a nozzle casting having the same overall dimensions, and where such a molten metal holding and pouring box can be used in combination with two separate stopper rod positioning and control apparatus independently controlling flow from each of the two nozzles in the assembly.

BRIEF SUMMARY OF THE INVENTION

In one aspect the present invention is a molten metal holding and pouring box having an upper rectangular-shaped section and a pyramidal-shaped lower section. A unitary dual nozzle assembly is located in a bottom region of the lower section.

In another aspect the present invention is a molten metal holding and pouring box having a pyramidal-shaped lower section with a unitary dual nozzle assembly in its lower section for use in pouring molten metal into two foundry molds at the same time. The pyramidal-shaped lower section provides for a relatively constant flow of the molten metal being poured from the box through each of the two nozzles in the unitary dual nozzle assembly.

In another aspect the present invention is a molten metal holding and pouring box that has an upper rectangular-shaped section and a lower inverted pyramidal-shaped section housing a unitary dual nozzle assembly with a pair of nozzles. The unitary dual nozzle assembly is positioned within a bottom region of the lower inverter pyramidal-shaped section, and is constructed of a thermally conductive material and insulated from contact with the lower inverted pyramidal-shaped section while being in thermal contact with the molten metal contained within the box during pouring and non-pouring periods through the pair of nozzles. A pair of stopper rods engages the pair of nozzles for controlling the flow of the molten metal to be poured through each of the pair of nozzles. Each of the pair of stopper rods can be arranged so that when the nozzle insertion ends of the pair of stopper rods are inserted in a conical funnel-shaped inlet of the pair of nozzles to stop the flow of the molten metal through the pair of nozzles a portion of the conical funnel-shaped inlet in each of the pair of nozzles is in contact with the molten metal in the box. A unitary dual nozzle retention plate can be removably fastened to the bottom of the pyramidal-shaped lower section of the box around the outlet of each one of the pair of nozzles in the unitary dual nozzle assembly.

In another aspect the present invention is a method of replacing an existing unitary dual nozzle assembly in a molten metal holding and pouring box with an upper rectangular-shaped section and a lower pyramidal-shaped section for pouring molten metal into a pair of molds. The existing unitary dual nozzle assembly is located in a bottom of the lower pyramidal-shaped section and has a pair of nozzles spaced apart from each other at a first distance. An insulating material surrounds the existing unitary dual nozzle assembly and a unitary dual nozzle retention plate retains the bottom of the existing unitary dual nozzle assembly in the box. The unitary dual nozzle assembly retention plate is removed from the bottom of the existing unitary dual nozzle assembly by removing a pair of retaining fittings from a pair of retaining posts holding the unitary dual nozzle assembly retention plate to the bottom of the box. An insulating material surrounding the sides of the existing unitary dual nozzle assembly is removed to release the existing unitary dual nozzle assembly from the box. A new unitary dual nozzle assembly is inserted into the bottom of the box. The new unitary dual nozzle assembly has the same overall dimensions of the existing unitary dual nozzle assembly with a pair of nozzles spaced apart from each other at a second distance, which distance is different from the first distance for the existing unitary dual nozzle assembly. The insulating material is installed around the sides of the new unitary dual nozzle assembly, and the unitary dual nozzle assembly retention plate is installed to the bottom of the new unitary dual nozzle assembly by inserting the pair of retaining fittings to the pair of retaining posts to hold the unitary dual nozzle assembly retention plate against the bottom of the new unitary dual nozzle assembly.

These and other aspects of the invention are described in this specification and the appended claims.

BRIEF DESCRIPTION OF THE DRAWINGS

For the purpose of illustrating the invention, there is shown in the drawings a form which is presently preferred; it being understood, however, that this invention is not limited to the precise arrangement and instrumentality shown.

FIG. 9(*b*) is a perspective view of one example of a fitting used to retain the retaining plate shown in FIG. 8 against the molten metal holding and pouring box when it is mounted on the retaining posts shown in FIG. 9(*a*).

FIG. 10(*b*) is at top plan view of the unitary dual nozzle assembly shown in FIG. 10(*a*); FIG. 10(*c*) is a cross sectional elevation view of the unitary dual nozzle assembly through line C-C in FIG. 10(*b*); and FIG. 10(*d*) is a cross sectional elevation view of the unitary dual nozzle assembly through line D-D in FIG. 10(*a*).

DETAILED DESCRIPTION OF THE INVENTION

Figure 1:
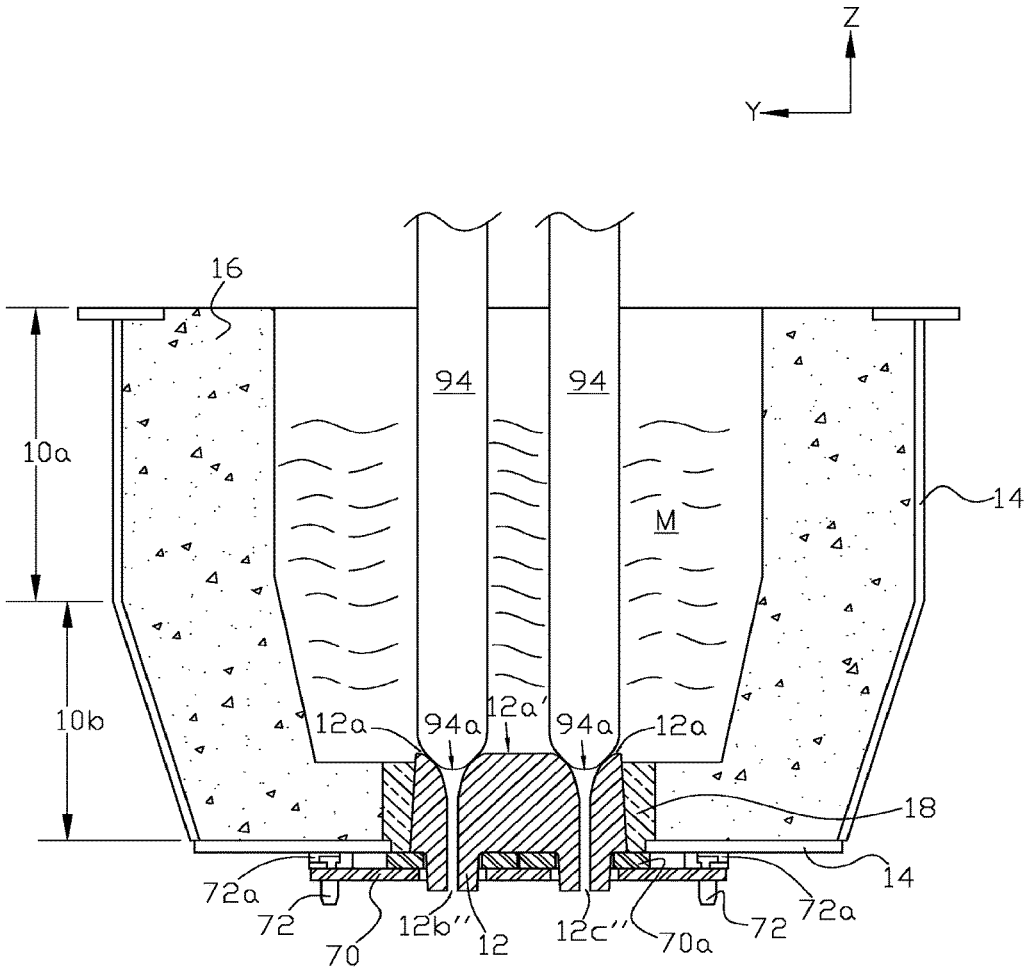
FIG. 1 is a simplified cross sectional view through line A-A in FIG. 3 of one example of a molten metal pouring and holding box of the present invention illustrating an installed unitary dual nozzle assembly in the pyramidal-shaped lower section of the box.
Figure 2:
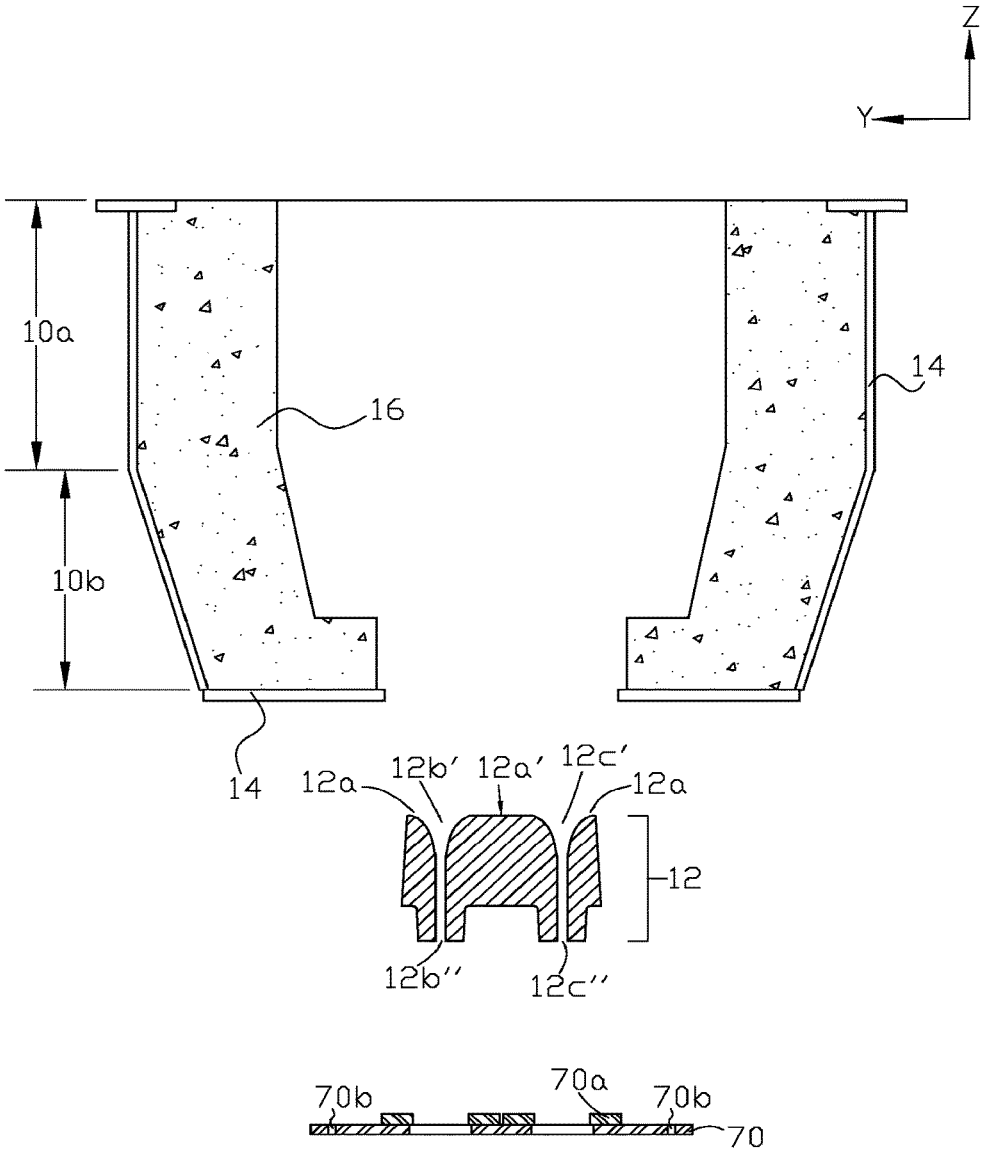
FIG. 2 is the cross sectional view of FIG. 1 with the unitary dual nozzle assembly removed from the molten metal pouring and holding box.
Figure 3:
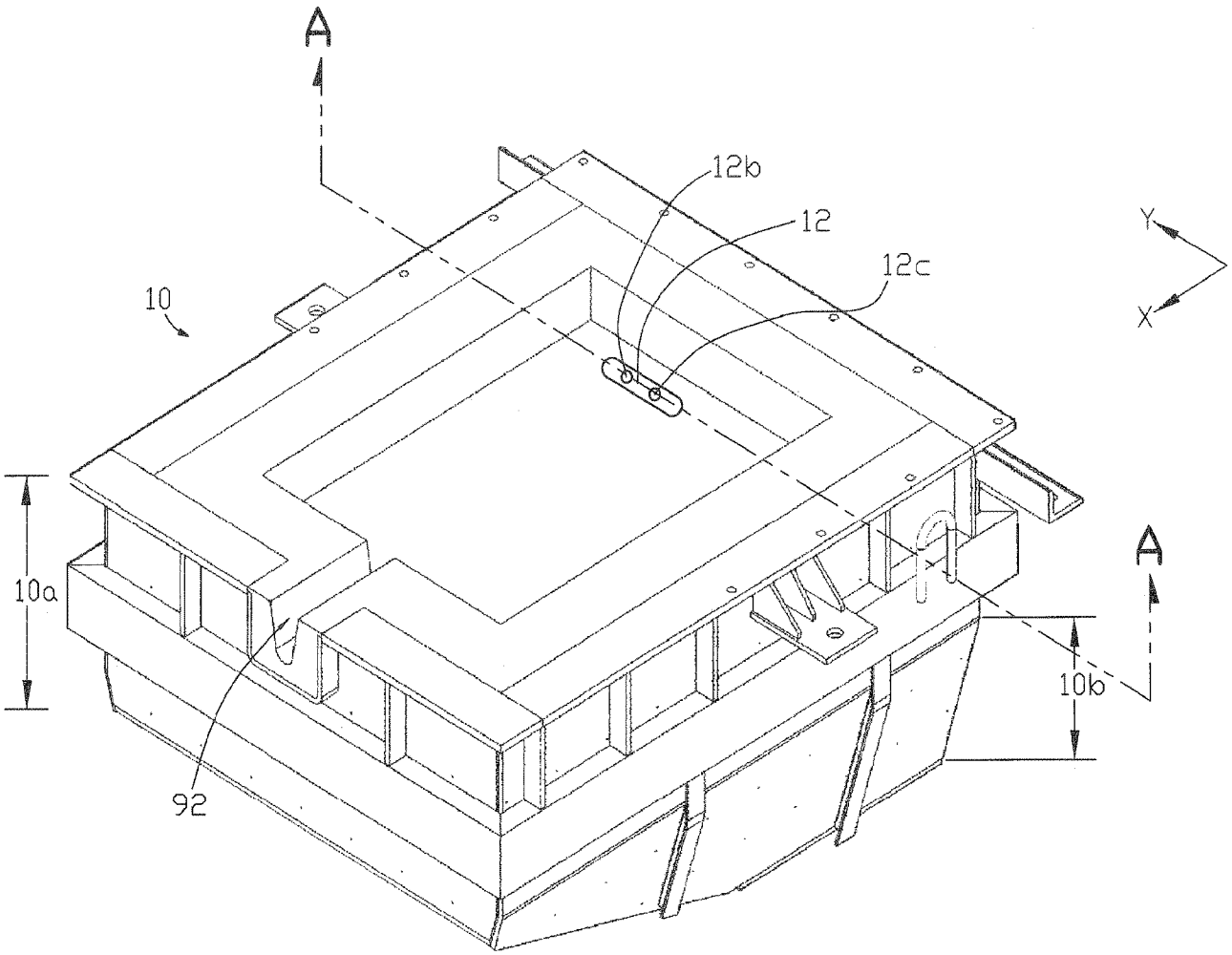
FIG. 3 is a top perspective view of one example of a molten metal pouring and holding box of the present invention with a unitary dual bottom pour nozzle assembly in the pyramidal-shaped lower section of the box.

Referring now to the drawings, wherein like numerals indicate like elements, there is shown in the figures one example of a molten metal pouring and holding box 10 having a pyramidal-shaped lower section with a unitary dual nozzle assembly 12 that can be used in automated molding systems found in casting foundries. A typical automated molding system comprises a conventional conveyor line that transports a plurality of adjacent molds to a casting station where two adjacent molds that are to be cast are filled with molten metal from box 10 via nozzles 12*b* and 12*c* in the unitary dual nozzle assembly. Typically when two molds are filed at the same time, the mold conveyor line advances molds two at a time, either in-line or side-by-side, and at a constant speed. Molten metal holding and pouring box 10 provides the source of molten metal to be used for the casting of the molds.

The molten metal holding and pouring box 10 has positioned in its pyramidal-shaped bottom region at least one unitary dual nozzle assembly 12. Molten metal holding and pouring box 10 can be positioned directly above a pair of casting molds 80, as shown, for example, in FIG. 11. If required for a particular installation, a pair of orthogonally disposed X-directional and Y-directional trolley assemblies as disclosed, for example in UK Patent Application Publication No. GB 2,229,384 A to allow for adjustment of the positions of the two nozzles relative to the sprue cups 80*a* in molds 80 into which the molten metal is poured.

Molten metal holding and pouring box 10 comprises an upper rectangular-shaped section 10*a* and a lower pyramidal-shaped section 10*b*. An outer structural shell 14 contains at least a refractory material layer 16 that forms the inner molten metal holding rectangular and pyramidal shaped volumes. As in the prior art, box 10 can have a box cover that extends across the upper portion of the rectangular-shaped section 10*a*. Molten metal can be fed into box 10 through a closeable opening in the box cover. Box 10 can have a discharge port 92 formed into section 10*a* for pouring of molten metal from the box when the box is tilted as disclosed, for example, in U.K. Patent Application Publication No. GB 2,229,384 A.

As in the prior art box 10 can be optionally divided by a vertical baffle of heat refractory material, into a pouring section and a refilling section as further disclosed, for example, in U.K. Patent Application Publication No. GB 2,229,384 A.

The box cover can have a single, or a pair of separate openings that provides a passageway for the insertion of two stopper rods 94 into box 10. The stopper rods and associated positioning and control apparatus may be as disclosed in U.S. Pat. No. 4,953,761 or U.S. Patent Application Publication No. 2010/0282784 A1, both of which are incorporated herein by reference in their entireties. Stopper rods 94 can be independently positioned with stopper rod tips 94*a* seated (engaged) on the inlets 12*b*' and 12*c*' of nozzles 12*b* and 12*c* to block flow of molten metal, or independently raised by the associated positioning and control apparatus to allow flow of molten metal through one or both nozzles.

If required for a particular application, the molten metal holding and pouring box 10 can include means for tilting itself as disclosed, for example, in UK Patent Application Publication No. GB 2,229,384 A, so that unused molten metal can be removed from the box through discharge port 92.

Unitary dual nozzle assembly 12 is constructed of a thermally conductive material and extends upward within box 10 so that its upper peripheral inlet surfaces 12*a* and 12*a*' constantly remain in contact with the molten metal (M) held within box 10 whether or not a stopper rod is in engagement with one or both of the nozzles within assembly 12. Unitary dual nozzle assembly 12 is preferably constructed of an alumina/silica material or other suitable low thermal resistance refractory metal, and the nozzles used therein preferably have circular inner dimensions with conical funnel-shaped inlets 12*b*' and 12*c*' and cylindrical-shaped outlets 12*b*" and 12*c*". The construction of unitary dual nozzle assembly 12 provides for its constant contact with the molten metal within the interior of box 10, particularly in the central region 12*a*' of the assembly between the nozzles. This constant contact causes the two nozzles within assembly 12 to always remain in a heat exchange relationship with the molten metal. This heat exchange relationship retards any clogging of the two nozzles that might otherwise occur during any cooling conditions to which the nozzles may be subjected.

Further the construction of the unitary dual nozzle assembly 12 eliminates the heat sink problem where the metallic structure (shell 14 and a reinforcing plate that is used to support a pouring nozzle as disclosed in U.K. Patent Application Publication No. GB 2,229,384 A) of the box 10 itself draws heat energy away from the pouring nozzles. In the present invention the unitary dual nozzle assembly 12 is surround by an insulating material 18 (as shown in FIG. 1) which insulates the dual nozzle assembly from heat sinks, along with insulation standoffs 70*a* on dual nozzle assembly retaining plate 70 as further described below.

Figure 11:
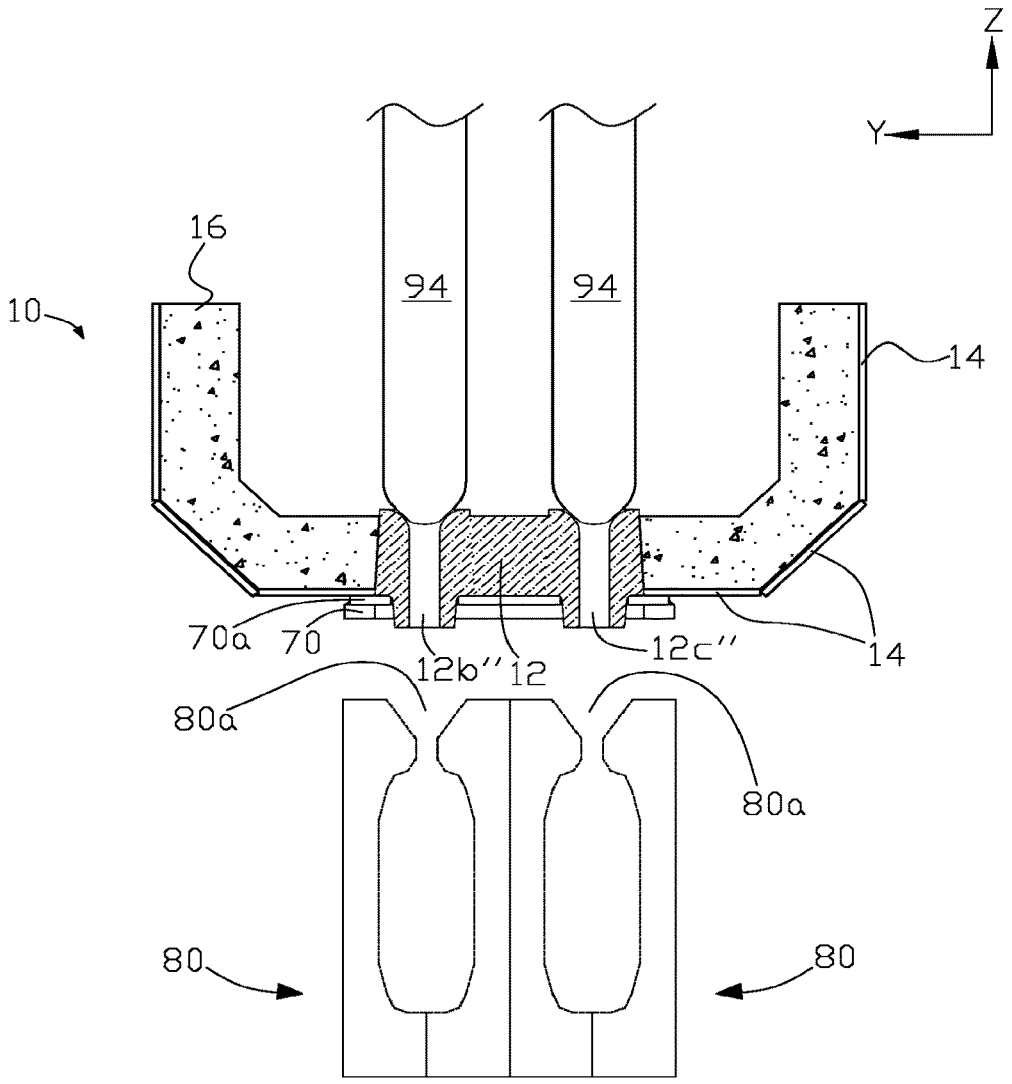
FIG. 11 is a partial cross sectional elevation view of a molten metal pouring and holding box having a pyramidal-shaped lower section of the present invention with a unitary dual pour bottom nozzle assembly of the present invention being used with two stopper rod positioning and control apparatus.

Unitary dual nozzle assembly 12 is shown, for example, in FIG. 11 as installed in a molten metal pouring and holding box having a pyramidal-shaped lower section. Details of one example of a unitary dual nozzle assembly 22 that can be used in the present invention are illustrated in FIG. 10(*a*) through FIG. 10(*d*). The unitary dual nozzle assembly 22 can also be used in a flat bottom launder as described in U.S. Patent Application Publication No. 2010/0282784 A1. In FIG. 10(*a*), the overall dimensions of a particular unitary dual nozzle assembly 22 are selected based on the maximum spacing between sprue cups on the pair of molds into which molten metal is to be poured through the nozzles in the unitary dual nozzle assembly. In FIG. 10(*a*) the maximum spacing between nozzle centers is defined as $x_1$ between nozzles 24*a* and 24*b* as cast, or otherwise formed, within the unitary dual nozzle assembly. Subsequent to installation and use of unitary dual nozzle assembly 22 as shown in FIG. 10(*a*), a requirement for closer spaced nozzles, such as nozzle pair 24*a*' and 24*b*' in FIG. 10(*b*) with a spacing of $x_2$ between nozzle centers can be cast, or otherwise formed in a unitary dual nozzle assembly having the same overall dimensions of the unitary dual nozzle assembly shown in FIG. 10(*a*) to accommodate a distance between sprue cup centers that is less than the maximum spacing.

Although a nozzle assembly is formed from heat resistant materials, the nozzle assembly will wear over a period of use with exposure to the flow of molten metals and have to be replaced. Typically replacement is accomplished without allowing the pour box structure surrounding the nozzle assembly to cool down, and therefore it is preferable to accomplish nozzle assembly replacement as quickly and efficiently as possible. In a double pour application, the single dual nozzle assembly, such as dual nozzle assembly 12 or 22 in FIG. 10(*a*) through FIG. 10(*d*) accomplishes this requirement. Further a single dual nozzle assembly of the present invention allows the distance between the openings of each nozzle in the dual nozzle assembly to be changed when the replacement dual nozzle assembly is originally cast or otherwise formed. For example as shown in FIG. 10(*b*) the distance $x_1$ between centers of nozzle openings for nozzle pair 24*a* and 24*b* (shown in solid lines) as cast in a first dual nozzle assembly, can be changed to distance $x_2$ between centers of nozzle openings for nozzle pair 24*a*' and 24*b*' (shown in dashed lines) as cast in a second dual nozzle assembly having the same overall dimensions as the first dual nozzle assembly. Thus a significant change in the distance between, and relative positions of each nozzle in a single dual nozzle assembly having the same overall dimensions can be achieved. Comparatively if two single replacement nozzle assemblies are used, the distance between centers of the nozzle openings must be accomplished during the actual fitting of the two single replacement nozzle assemblies in the bottom of a hot pour box. The ability to change the length between centers of the two separate nozzle openings is related to the length (or location) between sprue cups 80*a* in adjacent molds in a dual pour automated mold line as shown, for example, in FIG. 11. That is, in a dual pour process utilizing a single molten metal holding and pouring box with a pyramidal-shaped lower section, if the relative locations of sprue cups in adjacent molds in an automated line of molds changes, then the relative locations of the dual nozzles will also need to be changed by changing out the nozzle assemblies. The stopper rod positioning features of the stopper rod positioning and control apparatus 10 as disclosed in U.S. Patent Application Publication No. 2010/0282784 A1 can be used to quickly adjust the stopper rod position of each apparatus to changes in positions of the nozzles in a newly installed unitary dual nozzle assembly.

Figure 8:
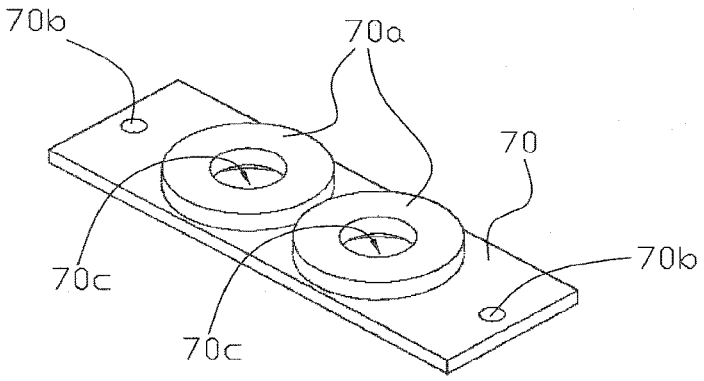
FIG. 8 is a perspective view of one example of a unitary dual nozzle retaining plate used in the present invention to retain the unitary dual nozzle assembly in a molten metal pouring and holding box of the present invention.
Figure 9A:
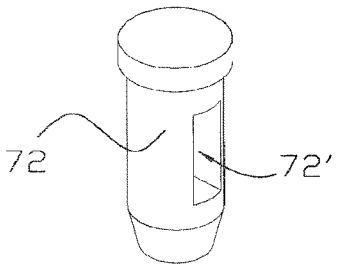
FIG. 9(*a*) is a perspective view of one example of a retaining post used in the present invention to mount the unitary dual nozzle retaining plate shown in FIG. 8 in place on the molten metal holding and pouring box.
Figure 7:
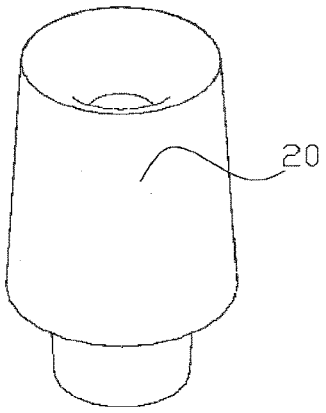
FIG. 7 is a perspective view of a single nozzle.
Figure 9B:
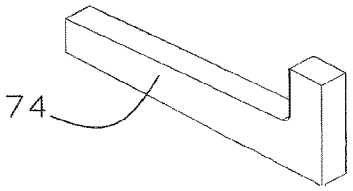
Figure 10D:
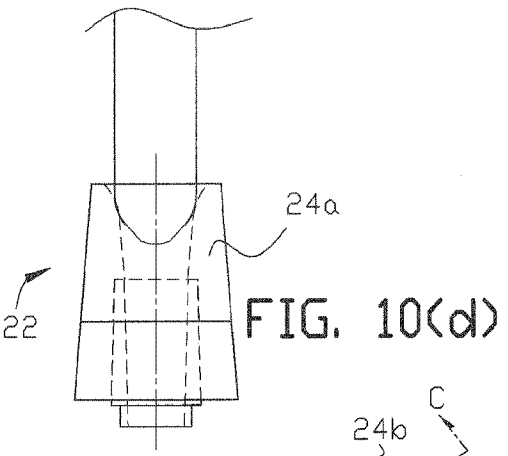
FIG. 10(*a*) is an isometric view of one example of a unitary dual nozzle assembly used in one example of the molten metal holding and pouring box having a pyramidal-shaped lower section of the present invention.
Figure 10A:
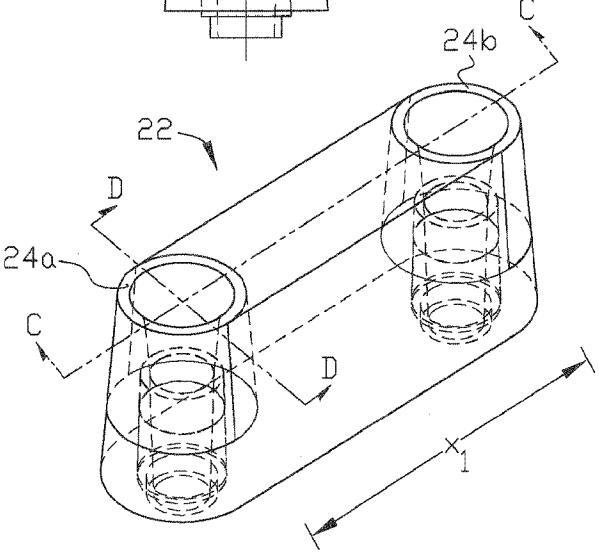
Figure 10C:
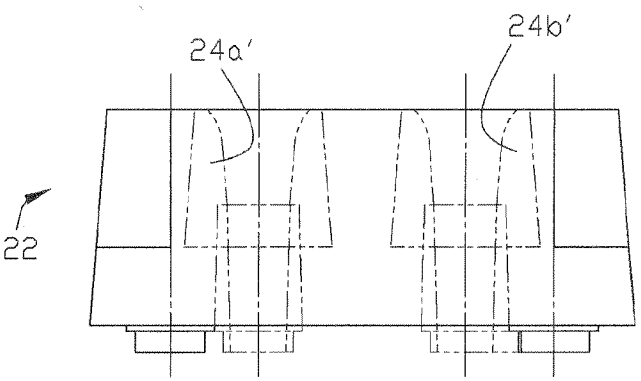
Figure 10B:
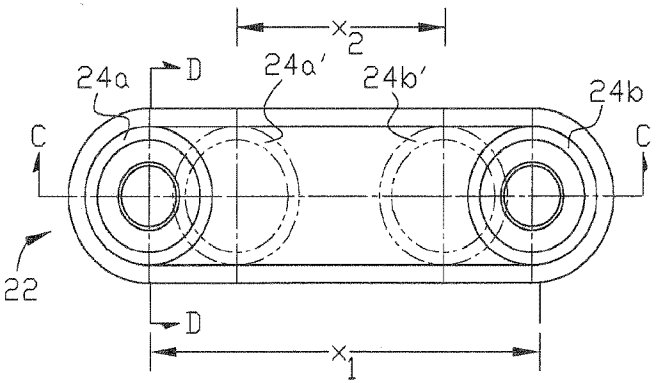

FIG. 8 illustrates on example of a unitary dual nozzle retaining plate 70 that can be used to provide support for a dual nozzle assembly installed in the molten metal pouring and holding box of the present invention. Retaining posts 72 (in FIG. 9(*a*)) can be suitably connected to the bottom of box 10 either directly or by intermediate connecting offset brackets 72*a*. Annular offsets 70*a* on retaining plate 70 fit up against the bottom of the box with openings 70*c* around the outlets 12*b*" and 12*c*" of each nozzle and the length of retaining posts 72 passing through openings 70*b* in the retaining plate. A fitting 74, for example, as shown in FIG. 9(*b*), is inserted into opening 72' in each retaining post to secure the unitary dual nozzle retaining plate in place. In change out of a dual nozzle assembly, fittings 74 are removed from the retaining posts to release the plate to provide a rapid means of removing an installed unitary dual nozzle assembly. After insulating material 18 is removed, the installed unitary dual nozzle can be removed from box 10, and replaced with a new unitary dual nozzle assembly with new insulating material packed around it and the unitary dual nozzle retaining plate is reinstalled. Thus the prior art heat sink problem is substantially eliminated in the present invention, since unitary dual nozzle assembly 12 is substantially surrounded by insulating material 18 and the insulating annular offsets 70*a* on the unitary dual nozzle assembly. This arrangement, in combination with regions 12*a* and 12*a*' of the dual nozzle assembly always being in contact with molten metal in the box, effectively eliminate the previously mentioned clogging problem.

As shown in the figures, box 10 comprises an upper rectangular-shaped section 10*a* and a lower inverted pyramidal section 10*b* housing the unitary dual nozzle assembly 12 in its bottom region. The upper rectangular-shaped section 10*a* may contain a volume $V_1$ of molten metal which may be expressed as:

$$V_1=0.5\cdot H\cdot W\cdot L \qquad \text{[expression (2)]}$$

wherein W and L respectively represent the width and length dimensions box 10, and H represents the head (H) dimension.

The lower inverted pyramidal-section 10*b* may contain a volume $V_2$ of molten metal which may be expressed as:

$$V_2=\tfrac{1}{6}\cdot H\cdot W\cdot L \qquad \text{[expression (3)]}.$$

The total volume $V_T$ of box 10, when full with molten metal, may be expressed as:

$$V_T=V_1+V_2=2.3\cdot H\cdot W\cdot L \qquad \text{[expression (4)]}.$$

The shape of box 10, in particular the pyramidal-shaped section 10*b*, advantageously provides a relatively constant flow (Q) (as previously discussed with reference to expression (1)) of molten metal outward from each nozzle in the dual nozzle assembly to a casting mold. As previously discussed, the relatively constant flow rate (Q) is not only advantageous to the mold casting process itself, but allows for the use of nozzles having small openings which, in turn, ease the task of accurately controlling the outflow of the molten metal from box 10. In particular, the pyramidal-shaped section 10*b* provides a pouring configuration that makes available approximately 75 percent of the volume ($V_T$) of the molten contained within box 10, to be poured into a pair of casting molds from the dual nozzles with a corresponding drop of only 50 percent in the pressure head (H), and a drop of only about 30 percent in the flow rate (Q). The flow rate (Q) and the pressure head parameters (H) provided by the present invention forces the molten metal through each of the dual pouring nozzles in a relatively constant manner.

In some examples of the invention the pair of nozzles in the unitary dual nozzle assembly need not have similar dimensions.

Figure 4:
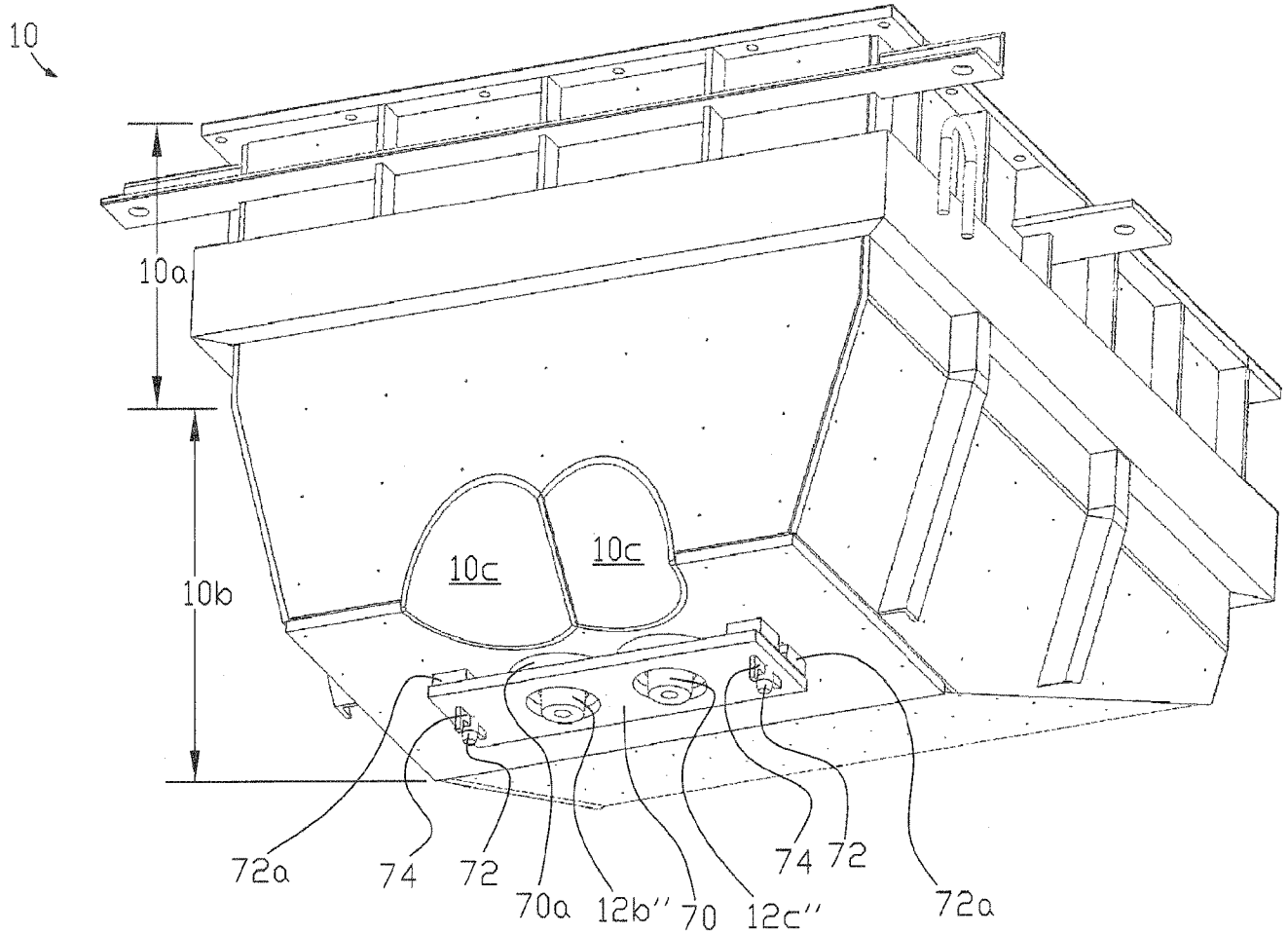
FIG. 4 is a bottom perspective view of the molten metal pouring and holding box shown in FIG. 3.
Figure 5:
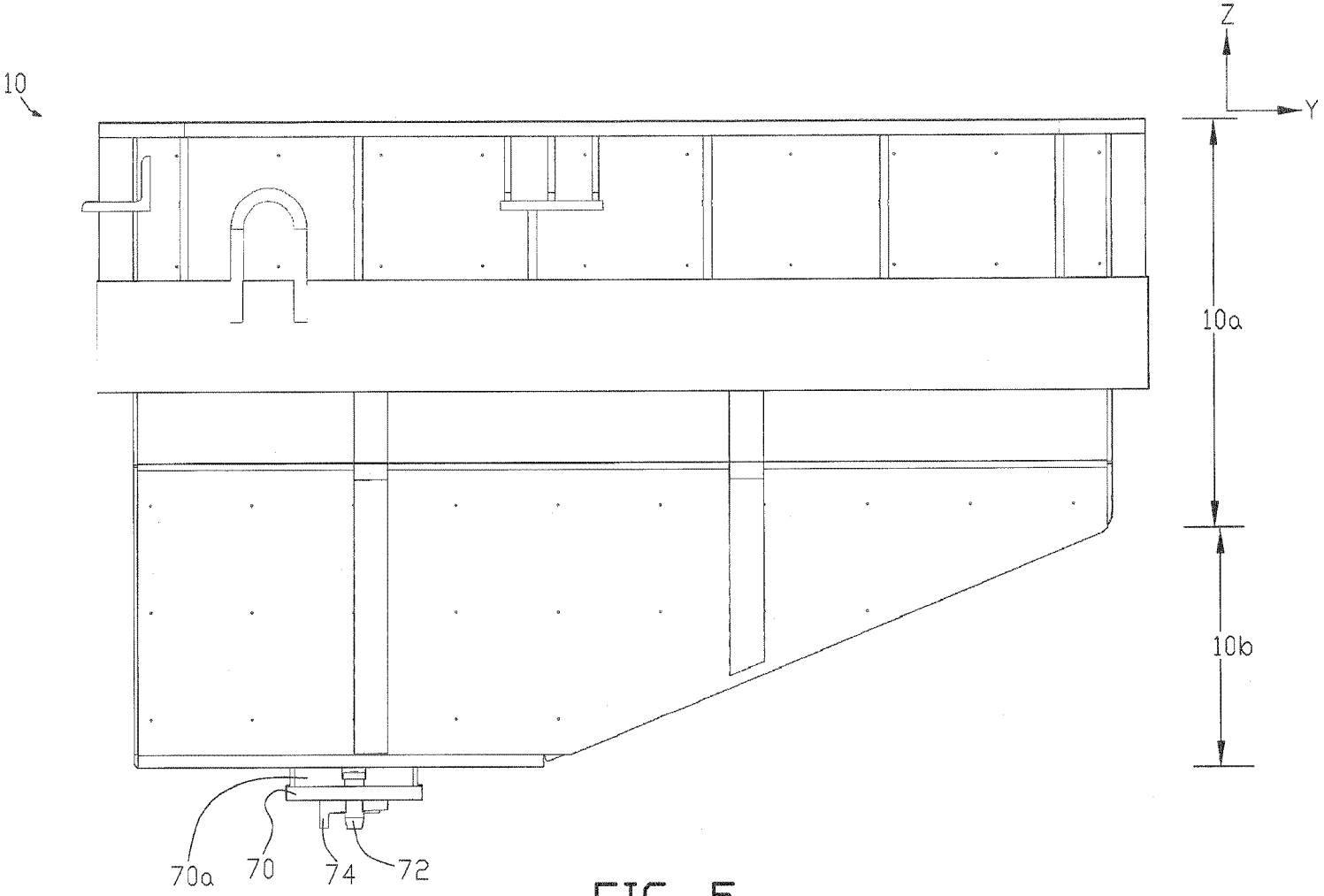
FIG. 5 is a side elevational view of the molten metal pouring and holding box shown in FIG. 3.
Figure 6:
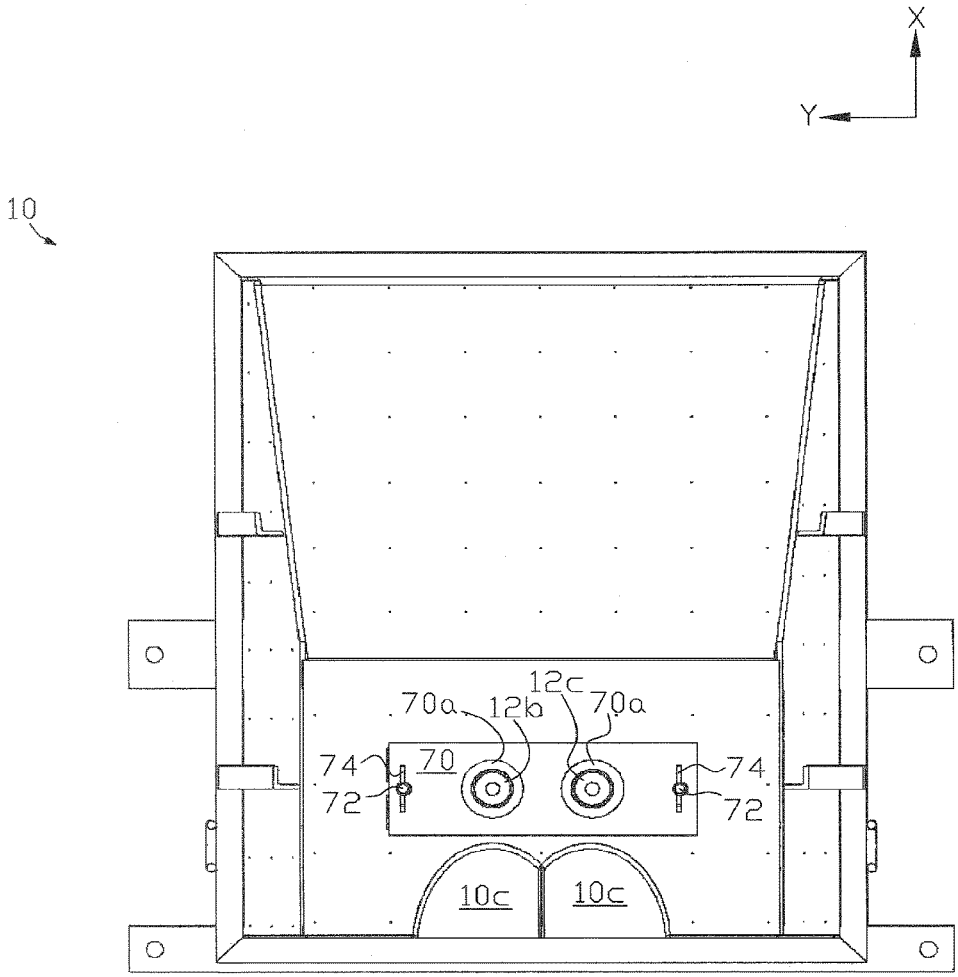
FIG. 6 is a bottom plan view of the molten metal pouring and holding box shown in FIG. 3.

Indentations 10*c* can be provided in the exterior of molten melt holding and pouring box 10 as shown in FIG. 4 for locating imaging apparatus for determination of when molten metal has reached a required level in each of the two sprue cups being filled from the open nozzles in the unitary dual nozzle assembly as disclosed, for example, in U.S. Pat. No. 4,744,407.

The present invention has been described in terms of preferred examples and embodiments. Equivalents, alternatives and modifications, aside from those expressly stated, are possible and within the scope of the invention.

The invention claimed is:

1. A method of replacing an existing unitary dual nozzle assembly in a molten metal holding and pouring box with an upper rectangular-shaped section and a lower pyramidal-shaped section for pouring a molten metal into a pair of molds, the existing unitary dual nozzle assembly located in a bottom of the lower pyramidal-shaped section and having a pair of nozzles spaced apart from each other at a first distance, an insulating material surrounding the existing unitary dual nozzle assembly and a unitary dual nozzle assembly retention plate retaining the bottom of the existing unitary dual nozzle assembly in the molten metal holding and pouring box, the method comprising the steps of:

removing the unitary dual nozzle assembly retention plate from the bottom of the existing unitary dual nozzle assembly by removing a pair of retaining fittings from a pair of retaining posts holding the unitary dual nozzle assembly retention plate to the bottom of the molten metal holding and pouring box;

removing a thermal insulating material surrounding the sides of the existing unitary dual nozzle assembly to release the existing unitary dual nozzle assembly from the molten metal holding and pouring box;

inserting a new unitary dual nozzle assembly into the bottom of the molten metal holding and pouring box, the new unitary dual nozzle assembly having the same overall dimensions as the existing unitary dual nozzle assembly, the new unitary dual nozzle assembly having a pair of new nozzles spaced apart from each other at a second distance, the second distance different from the first distance;

installing the thermal insulating material around the sides of the new unitary dual nozzle assembly;

thermally insulating the new unitary dual nozzle assembly from contact with the lower pyramidal-shaped section by a combination of the thermal insulating material surrounding the sides of the new unitary dual nozzle assembly and a thermal insulating standoff installed around an outlet of each one of the pair of new nozzles with the thermal insulating standoff disposed between a bottom of the unitary dual nozzle assembly and an upper side of the unitary dual nozzle assembly retention plate; and installing the unitary dual nozzle assembly retention plate to the bottom of the new unitary dual nozzle assembly by inserting the pair of retaining fittings to the pair of retaining posts to hold the unitary dual nozzle assembly retention plate against the bottom of the new unitary dual nozzle assembly with the outlet of each of the pair of new nozzles thermally insulated from the new unitary dual nozzle assembly.

2. The method according to claim 1 further comprising forming the pair of new nozzles from a low thermal resistance refractory metal.

3. The method according to claim 2 further comprising forming the new unitary dual nozzle assembly from a material selected from the group consisting of alumina and silica.

4. The method according to claim 2 further comprising forming each of the pair of new nozzles with a conical funnel-shaped inlet and arranging a nozzle insertion end of each of a pair of stopper rods so that when the nozzle insertion ends of the pair of stopper rods are inserted in the conical funnel-shaped inlet of the pair of new nozzles to stop a flow of the molten metal through the pair of new nozzles a portion of the conical funnel-shaped inlet in each of the pair of new nozzles is in contact with the molten metal in the molten metal holding and pouring box.

5. A method of replacing an existing unitary dual nozzle assembly in a molten metal holding and pouring box with an upper rectangular-shaped section and a lower pyramidal-shaped section for pouring a molten metal into a pair of molds, the existing unitary dual nozzle assembly located in a bottom of the lower pyramidal-shaped section and having a pair of nozzles spaced apart from each other at a first distance, an insulating material surrounding the existing unitary dual nozzle assembly and a unitary dual nozzle assembly retention plate retaining the bottom of the existing unitary dual nozzle assembly in the molten metal holding and pouring box, the method comprising the steps of:

removing the unitary dual nozzle assembly retention plate from the bottom of the existing unitary dual nozzle assembly by removing a pair of retaining fittings from a pair of retaining posts holding the unitary dual nozzle assembly retention plate to the bottom of the molten metal holding and pouring box;

removing a thermal insulating material surrounding the sides of the existing unitary dual nozzle assembly to release the existing unitary dual nozzle assembly from the molten metal holding and pouring box;

inserting a new unitary dual nozzle assembly into the bottom of the molten metal holding and pouring box, the new unitary dual nozzle assembly having the same overall dimensions as the existing unitary dual nozzle assembly, the new unitary dual nozzle assembly having a pair of new nozzles formed from a material selected from the group consisting of alumina and silica and spaced apart from each other at a second distance, the second distance different from the first distance, each of the pair of new nozzles having a conical funnel-shaped inlet and a nozzle insertion end of each of a pair of stopper rods arranged so that when the nozzle insertion ends of the pair of stopper rods are inserted in the conical funnel-shaped inlet of the pair of new nozzles to stop a flow of the molten metal through the pair of new nozzles a portion of the conical funnel-shaped inlet in each of the pair of new nozzles is in contact with the molten metal in the molten metal holding and pouring box;

installing the thermal insulating material around the sides of the new unitary dual nozzle assembly;

thermally insulating the new unitary dual nozzle assembly from contact with the lower pyramidal-shaped section by a combination of the thermal insulating material surrounding the sides of the new unitary dual nozzle assembly and a thermal insulating standoff installed around an outlet of each one of the pair of new nozzles with the thermal insulating standoff disposed between a bottom of the unitary dual nozzle assembly and an upper side of the unitary dual nozzle assembly retention plate; and installing the unitary dual nozzle assembly retention plate to the bottom of the new unitary dual nozzle assembly by inserting the pair of retaining fittings to the pair of retaining posts to hold the unitary dual nozzle assembly retention plate against the bottom of the new unitary dual nozzle assembly with the outlet of each of the pair of new nozzles thermally insulated from the new unitary dual nozzle assembly.

* * * * *